US006378145B1

(12) United States Patent
Wyss

(10) Patent No.: US 6,378,145 B1
(45) Date of Patent: Apr. 30, 2002

(54) COMBINED BATH TUB/SHOWER TUB DEVICE

(76) Inventor: Martin Wyss, Mühlestrasse 16, CH-6294 Ermensee (CH)

( * ) Notice: Subject to any disclaimer, the term of this patent is extended or adjusted under 35 U.S.C. 154(b) by 0 days.

(21) Appl. No.: 09/762,788

(22) PCT Filed: Aug. 10, 1999

(86) PCT No.: PCT/CH99/00371

§ 371 Date: Feb. 12, 2001

§ 102(e) Date: Feb. 12, 2001

(87) PCT Pub. No.: WO00/08991

PCT Pub. Date: Feb. 24, 2000

(30) Foreign Application Priority Data

Aug. 13, 1998 (CH) ..... 1665/98

(51) Int. Cl.[7] ..... A47K 37/02
(52) U.S. Cl. ..... 4/538
(58) Field of Search ..... 4/538, 592, 593, 4/594, 595, 552, 546, 550, 554, 597, 548, 549

(56) References Cited

U.S. PATENT DOCUMENTS 535,509 A * 3/1895 Ruby
760,540 A * 5/1904 Lancaster
1,235,091 A * 7/1917 Anderson
1,367,896 A * 2/1921 Simpson
1,632,668 A * 6/1927 Murphy
1,724,479 A * 8/1929 Havener
1,940,137 A * 12/1933 Mather
3,955,219 A * 5/1976 Finch et al.
4,337,540 A * 7/1982 Lindeman
4,970,734 A * 11/1990 Friedman et al.
5,996,140 A * 12/1999 Kitamura

FOREIGN PATENT DOCUMENTS

DE 3200115 7/1983
DE 3301283 A1 * 7/1983
DE 8915216 4/1990

* cited by examiner

*Primary Examiner*—Gregory L. Huson
*Assistant Examiner*—Khoa Huynh
(74) *Attorney, Agent, or Firm*—Sidley Austin Brown & Wood, LLP

(57) ABSTRACT

A device consisting of a combination of a bathtub (1) with a shower tray (3), in which the bathtub (1), when in position B=Bathing, is positioned over shower tray (3) in such a way that its water outlet ends up over the shower tray (3), whilst when in the other possible position S=Showering, it stands upright, i.e. end over end, on one of its ends, thereby freeing access to shower tray (3). Bathtub (1) can easily be manoeuvred from one position to the other by a lifting mechanism and the application of force, preferably generated by an electric motor (13). By completely separating the bathtub from the shower tray and by positioning the bathtub over the shower tray, the edge of the shower tray is on the one hand kept as low as it would be if there were indeed a separate shower tray, whilst on the other hand, the edge of the bathtub is only slightly raised. As a result, both parts are extremely user-friendly, especially for elderly or handicapped persons. The device does not require any more space than a conventional bathtub alone whilst also providing an additional full shower facility in the same space.

8 Claims, 5 Drawing Sheets

COMBINED BATH TUB/SHOWER TUB DEVICE

The invention concerns a device consisting of a combination of a bathtub with a shower tray according to the preamble of claim 1.

In many bathrooms there is no room for a separate shower and bath, and so baths combined with shower devices have been available for quite some time. In one extremely simple, and therefore very widely used solution, the conventional bath is fitted with a shower curtain or a folding shower cabin. In this case the shower device is a hand-held shower which can be attached to a shower holder.

The prior art also includes bathtubs that are specially shaped—the bottom of the bath in particular—in the shower area, whether at the foot end (DE 35 09 732) or in the centre (PCT/EP 89/01593). The foot end of a normal bath is usually characterised by a relatively steep inner wall, whilst the inner wall at the sitting end is less steep so that the bather can comfortably lean his or her back against it; the water outlet for the bath is normally provided somewhere in the foot zone.

One of the disadvantages of these types of shower/bath combinations is that the user has to climb over the relatively high edge of the bath to take a shower, which is not only awkward, but also dangerous for elderly or handicapped persons.

With this in mind, designers have already suggested (DE 195 03 514) leaving a gap in the side of the bath which would facilitate entry into the shower zone and could be closed off with an insertable wall component for the purpose of taking a bath. In this case, however, watertightness would pose a considerable problem. Furthermore, this design also requires a specially constructed, relatively complicated bath.

Patent DE 32 42 574, which forms the preamble of claim 1, proposes a shower tray that can be swung downwards until it comes to rest on top of an existing bathtub. This means that to take a shower, the user has to climb up the equivalent of the height of the bathtub, which requires a stool or steps.

The present invention is based on the task of providing a combination of a bathtub with a shower tray that does not have the said disadvantages of the combinations commonly available to date.

This task is solved with the aid of the features of claim 1 according to the invention. Other preferred embodiments of the invention are the subject of the dependent claims.

The invention proposes a device consisting of a combination of a bathtub with a shower tray, each of which is provided with its own water outlet or corresponding opening. The front wall of the bathtub is preferably steeper at the water outlet end, i.e. at the front end (=foot end) in relation to the bather's seated position, than at the opposite end where the bather is seated (=back end). There is also a water inlet means for the bathtub and a vertically adjustable shower with the appropriate plumbing installations for the shower tray. This invention is firstly characterised in that, when in position B (B=Bathing), the bathtub is positioned over the shower tray in such a way that its water outlet ends up over the shower tray. A further characteristic feature of this invention is that, when in the other possible position S (S=Showering), the bath stands upright, i.e. end over end, on one of its ends, thereby freeing access to the shower tray. The final characteristic feature of this invention is that the bathtub can easily be manoeuvred from position S to position B and back again by means of a tilting and/or lifting mechanism and the application of force. An electric motor is preferably used to provide this force. A suitable mechanism is also provided for blocking the bathtub and its lifting mechanism, at least when it is in position S.

With reference to preferred position(s) of the bathtub, this invention also suggests that, when in position S, the bathtub be contrived to stand directly against one of the bathroom walls, and more specifically in such a way that its opening be directed towards the interior of the room, with its water outlet end, i.e. the steeper wall, at the bottom.

On the underside of the bathtub there are four wheels, by means of which the bathtub can be moved from position B to position S and back again. The wheels run along the edge of the shower tray and along the wall in grooves in the covers of the lifting mechanism described below.

For the lifting mechanism it is proposed that the force supplied by the motor be transmitted to a drive shaft. This drive shaft then transfers the force to two spindles by means of rotary deflections. On each of these spindles there is a coupling with an internal gear. The two couplings carry a drawbar in the middle, which is in turn connected to the bathtub. By rotating the spindles, the bathtub can therefore be raised or lowered.

At both ends of the bathtub there are also panels of different sizes, rather like the side walls of a shower cubicle, which on the one hand serve to protect against splashes of water whilst on the other hand also preventing users from being exposed to any danger from the mechanism. They also fulfill an aesthetic function; in position S, for example, the bathtub is concealed behind the panel. The gap between these two panels can be closed off by means of a sliding door when showering and—for safety reasons—when manoeuvring the bathtub.

The suggested device consisting of a combination of a bathtub with a shower tray will be described in more detail below with reference to examples of various embodiments. It is also depicted in the drawings, in which.

Figure 1:
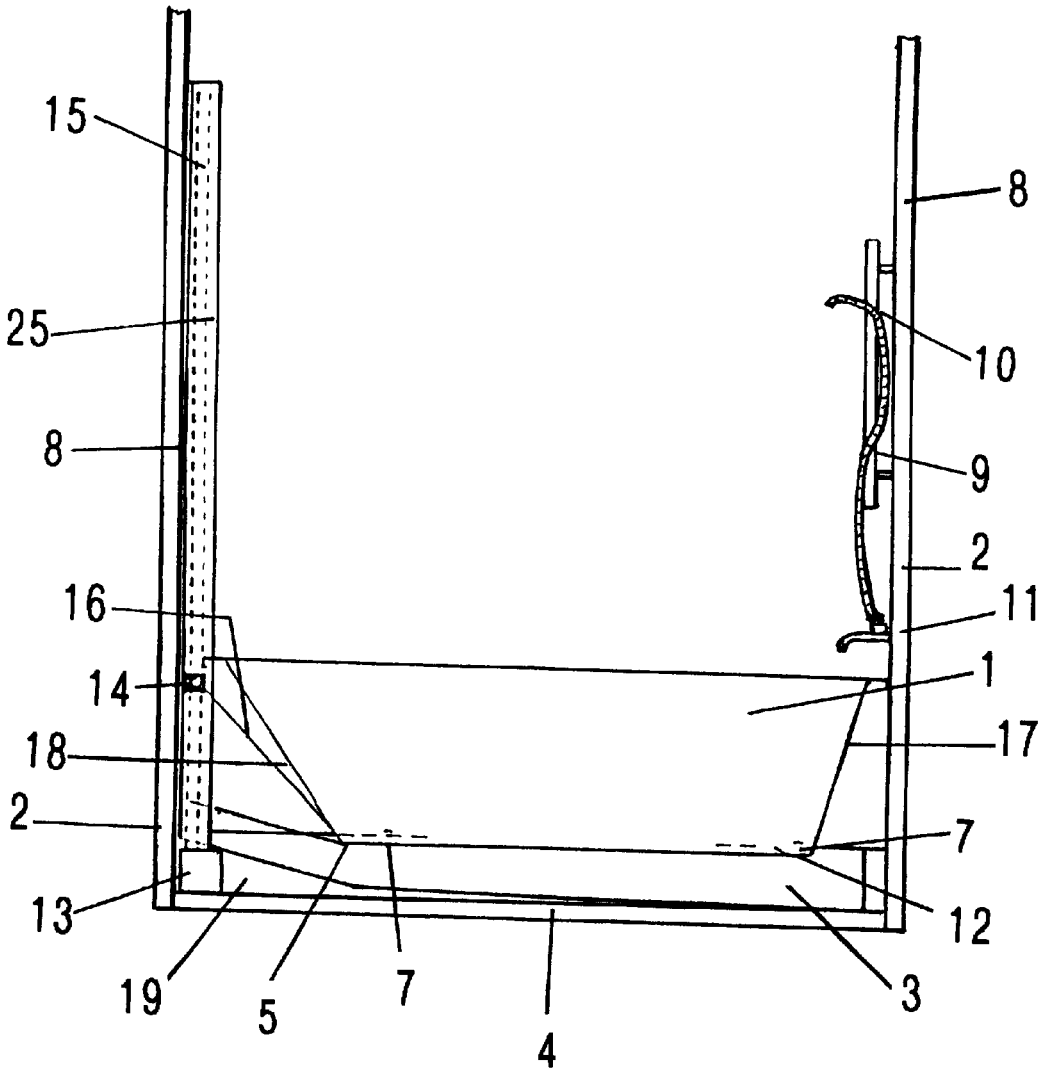
FIG. 1 is a side view of the device according to the invention, with the corresponding lifting mechanism (longitudinal section)
Figure 5:
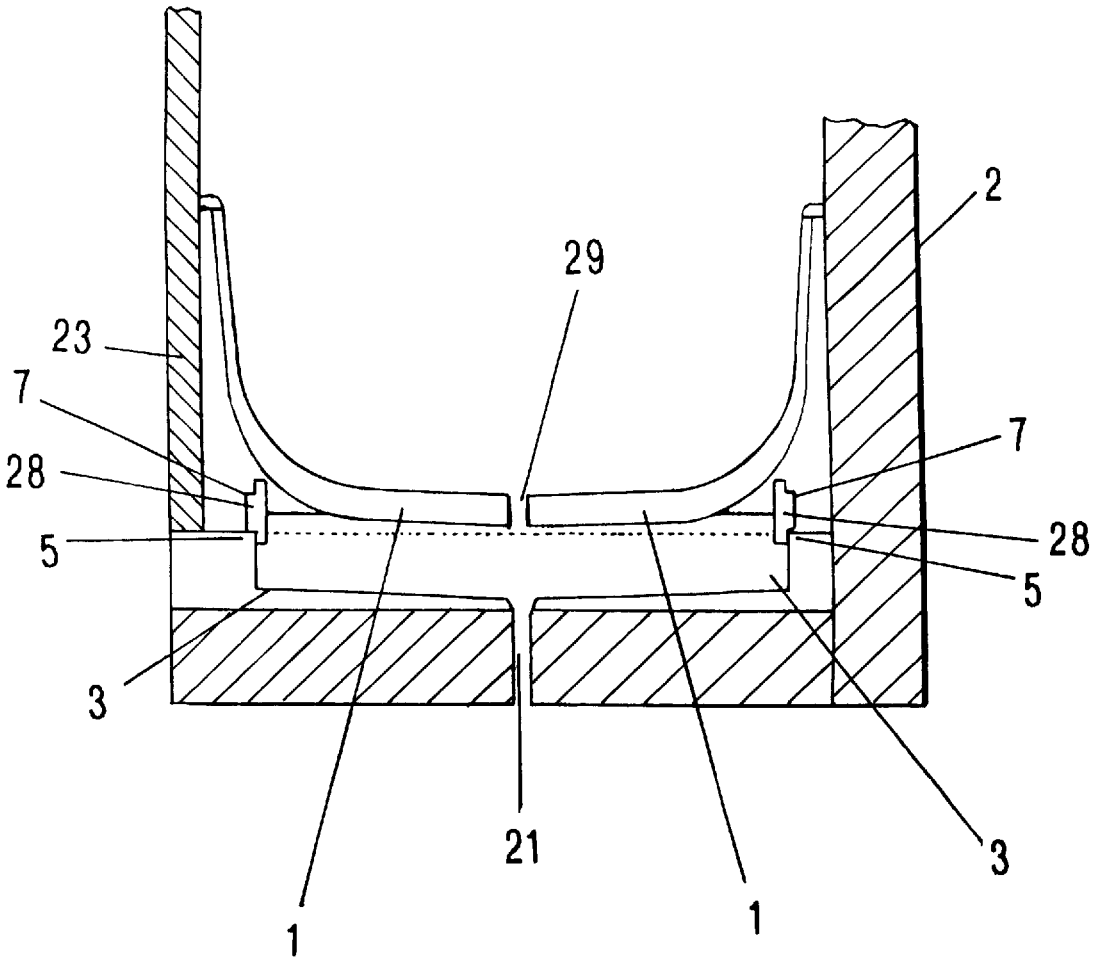
FIG. 5 is a section through the device of the invention according to FIG. 1.

FIG. 1 shows a device consisting of a combination of a bathtub 1 with a shower tray 3, with water outlets (29) which are contrived to coincide with each other. Bathtub 1 is also provided with an overflow protection 22 (see FIG. 2). Wheels 7 are attached to all four bottom corners of bathtub 1. Wheels 7 are arranged in pairs on an axle 28 and each have a wheel flange (see FIG. 5). These wheels 7 run along the inside of edge 5 of the shower tray. Bathtub 1 can also be fixed in position B by running wheels 7 into a recess 12 in the edge 5 of shower tray 3. Shower tray 3 runs along the whole length of bathtub 1 on the floor 4 of the bathroom. Exactly like bathtub 1, it is also tapered at the end opposite the plumbing installations.

Figure 4:
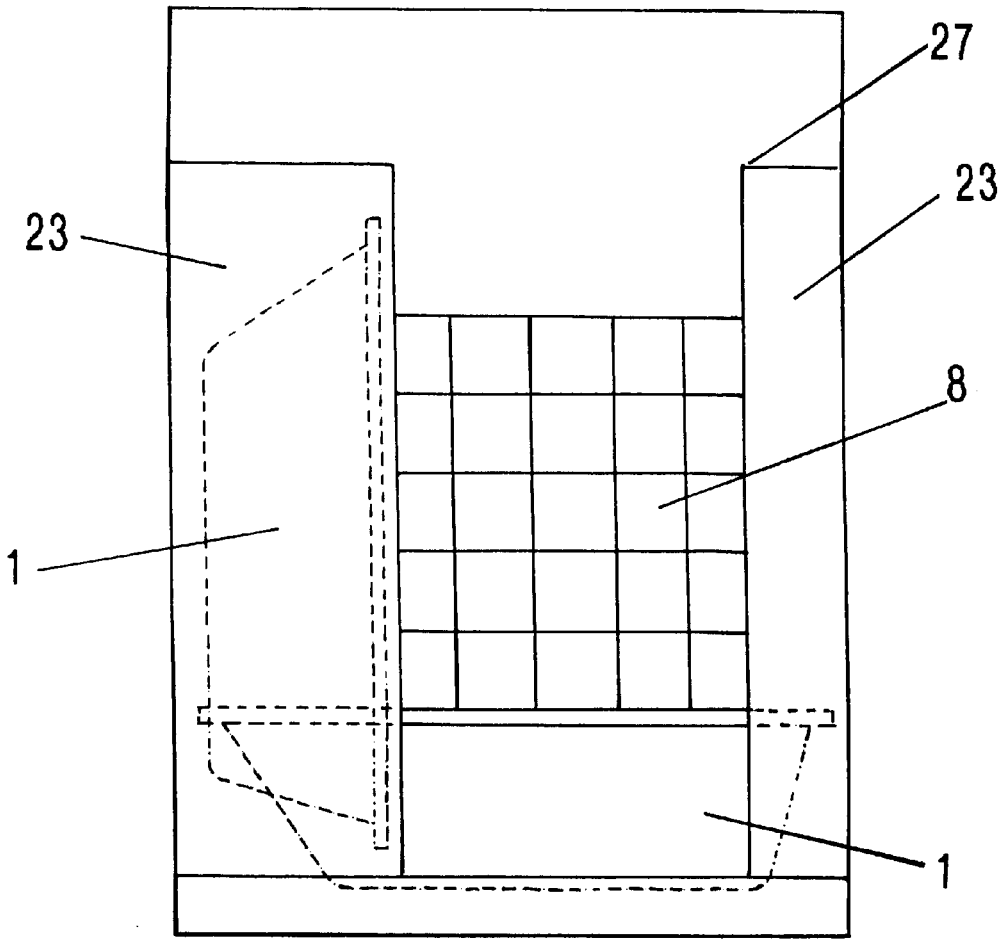
FIG. 4 is a side view of the device of the invention according to FIG. 1 showing the side panels.

Attached to wall 2, against which abuts the foot end 17 of bathtub 1, there is a tap 11 for bathtub 1 and a hand-held shower 10 that can be moved up and down rod 9 for the shower. Tap 11 can be designed either as a single-lever mixer or as a mixer tap. Walls 2, which surround the combination of the invention on three sides, are, as is usual in bathrooms, preferably provided with a wall covering 8 consisting of ceramic tiles (see FIG. 4).

Figure 2:
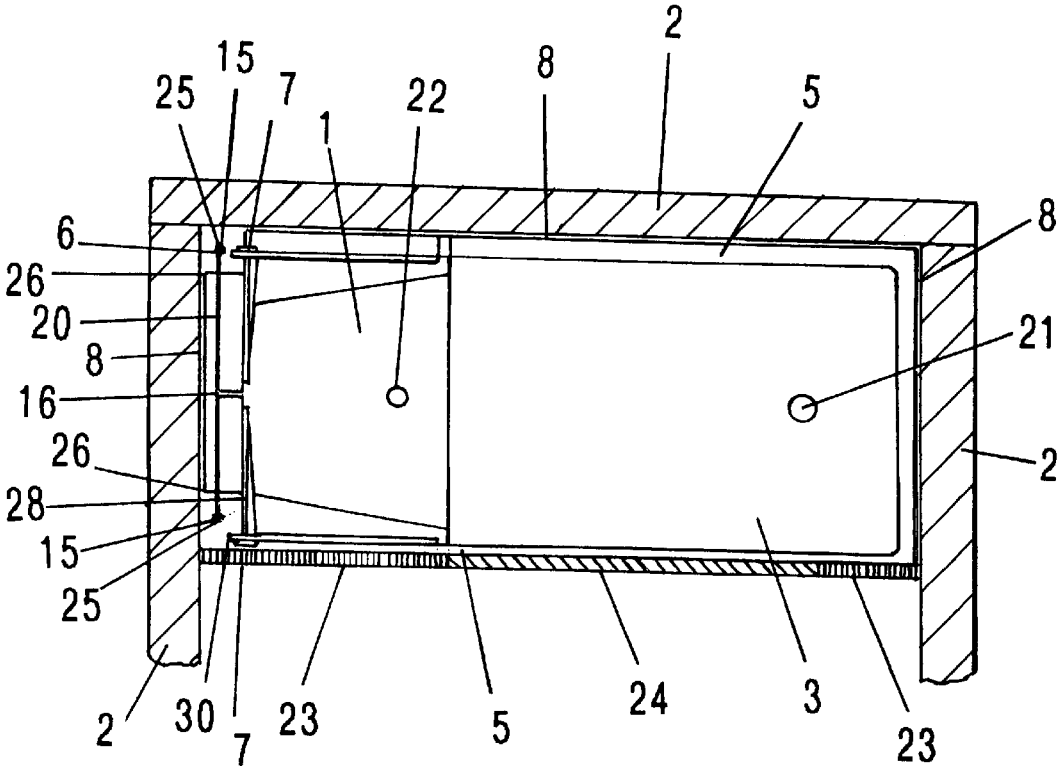
FIG. 2 is a top plan view of the device of the invention according to FIG. 1 (the bathtub is in position S)

Bathtub 1, which is attached to drawbar 16, which is provided on both sides with a joint, is lifted as a result of couplings 14 being displaced upwards when spindles 15 are rotated. Drawbar 16 is attached to the cross-bar 20 fixed between the two couplings 14 (see FIG. 2). Spindles 15 are driven by a motor 13, which is housed in a recess 19 underneath shower tray 3. The force is transmitted by means of a rotary deflection from a horizontal drive shaft of motor 13 to spindles 15. Covers 25 serving both aesthetic and safety purposes, are preferably attached to wall 2. To allow movement of cross-bar 20, which lifts up bathtub 1 by means of drawbar 16, slits 26 are provided along the full height of covers 25. Wheels 7 of bathtub 1 run along grooves 6 in covers 25. FIG. 2 also shows the two differently sized panels 23 in the form of a transparent partition, preferably made from plastic, which are similar to the side wall of a conventional shower cubicle, and the sliding door 24, which is made from the same material (see also FIG. 4).

A second version (not shown) of the lifting mechanism is characterised in that the force is exerted via a cable pull or chain pull system which runs from a fixation point on the bathtub via a deflector roller attached towards the top of the wall to an electric motor fitted with a cable winch.

Figure 3:
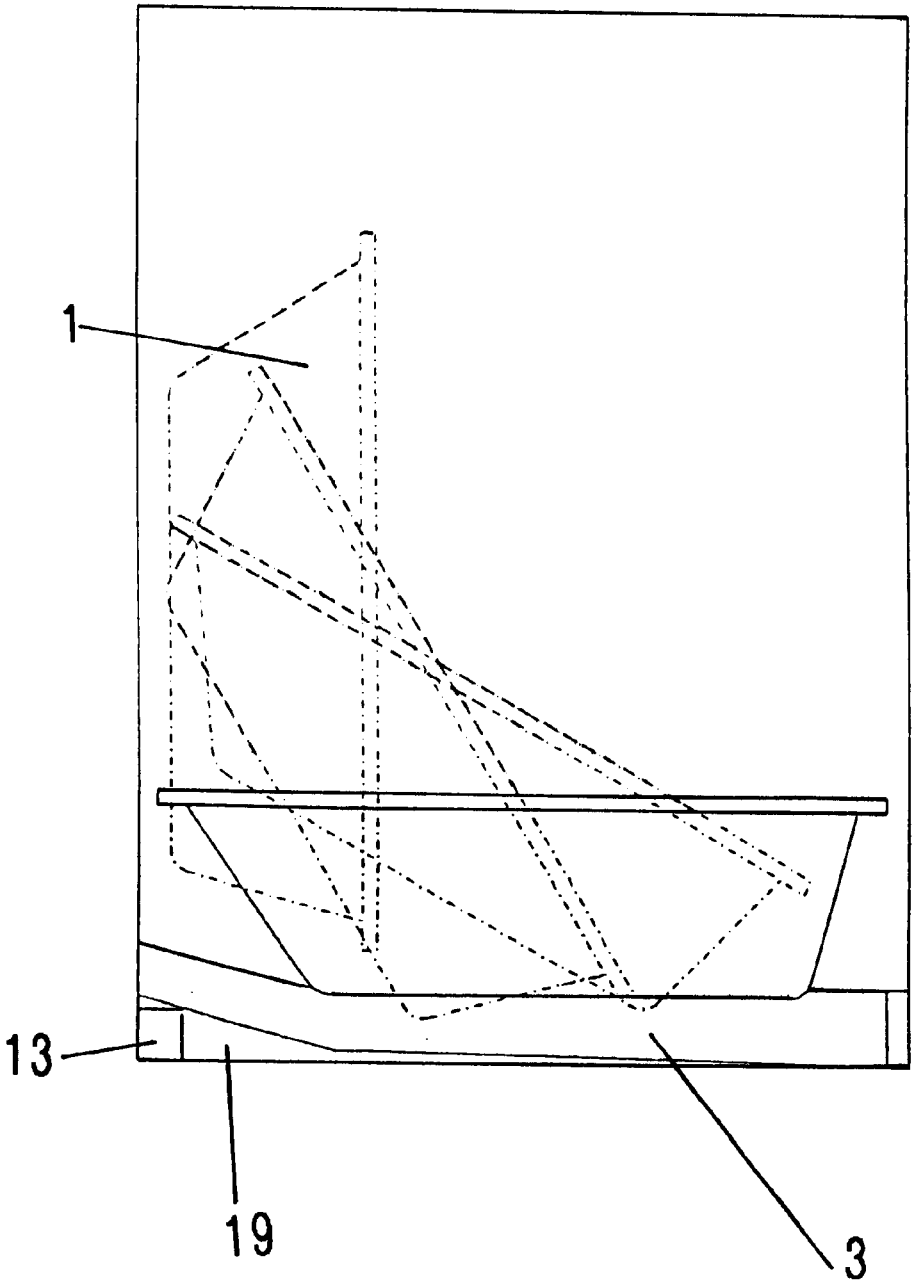
FIG. 3 is a diagrammatic side view of the device of the invention according to FIG. 1 showing four possible positions of the bathtub during the pivoting operation to move it from position B to position S.

The different phases involved in moving the bathtub from position B to position S, i.e. when the bathtub is raised from the horizontal to the vertical position, are shown diagrammatically in FIG. 3. FIG. 2 also shows a top plan view of the bathtub in the raised position. When the bathtub is raised, wheels 7 run in a groove 6 in covers 25 of spindles 15.

For safety reasons, bathtub 1 can only be raised or lowered when sliding door 24 is shut. When sliding door 24 is shut, a contact 27 in panel 23 is triggered (see FIG. 4). Motor 13 is also preferably provided with an overload fuse which prevents bathtub 1 from being raised when it contains any weight. This means that bathtub 1 cannot be raised if there is a person or any water in tub 1.

Finally, another embodiment not shown here is also conceivable, in which the bathtub/shower tray combination is not surrounded by three walls, but stands in the corner of a large bathroom. The plumbing installations such as the water inlet and shower attachment are then attached to the wall on the longitudinal side of the bathtub, whilst an additional cover in the form of a side wall is provided at the foot end of the bathtub. This would create space in the bathroom for other sanitary installations such as a bidet, for example.

The proposed bath/shower combination has considerable advantages over the previously used combinations: By completely separating the bathtub from the shower tray, and by positioning the bathtub over the shower tray the edge of the shower tray is on the one hand kept as low as it would be if there were indeed a separate shower tray, whilst on the other hand, the edge of the bathtub is only slightly raised. As a result, both parts are extremely user-friendly, especially for elderly or handicapped persons. As the bathtub can easily and very safely be pivoted and positioned end over end against a wall by means of a lifting mechanism and an electric motor, the combination requires scarcely more space than a conventional bathtub alone, whilst also providing an additional full shower facility in the same space. None of the prior art combinations of baths and showers provides this combination of advantages.

What is claimed is:

1. A device consisting of a combination of a bathtub (1) with a shower tray (3), with the bathtub (1), when in position B for bathing, being positioned over the shower tray (3), and when in position S for showering, standing upright on one end, thereby leaving free access to at least part of the shower tray (3), characterized in that the device is provided with grooves (6) which, when the device is installed, are disposed along walls (2) abutting against the shower tray (3), and in that on an underside of the bathtub (1) there are four wheels (7) which, when the bathtub (1) is maneuvered from position B to position S and back again, run along edges (5) of the shower tray (3) and along grooves (6) in the walls (2).

2. The device of claim 1, characterized in that the bathtub (1) can be maneuvered from position B to position S and back again by means of a lifting mechanism (14, 15, 16, 20).

3. The device of claim 2, characterized in that the lifting mechanism (14, 15, 16, 20) has a motor (13) whose drive shaft transmits a force via two spindles (15) to two couplings (14), each coupling disposed on each spindle (15), the two couplings (14) being supported in the middle, by means of a cross-bar (20), and a drawbar (16) connected to the bathtub (1).

4. The device of claim 1, characterized in that a water outlet (29) of the bathtub (1) ends up over the shower tray (3) when in position B.

5. The device of claim 1, characterized in that the bathtub (1) stands end over end when in position S, said bathtub having an open top and a steeper tub wall (17).

6. The device of claim 5, characterized in that in position S, the bathtub (1) stands against one of said walls (2) in such a way that the open top is directed towards the shower tray (3) with the steeper tub wall (17) at the bottom.

7. The device of claim 1, characterized in that two differently sized panels (23) are provided on both sides of a sliding door (24), with the first panel (23) facing one of said walls and being dimensioned so that the bathtub (1) is concealed behind it when in position S.

8. The device of claim 7, characterized in that a contact (27) is provided in the second panel (23), and the bathtub (1) can only be moved from one position to another when the sliding door (24) is shut, which triggers the contact (27) in the second panel (23).

* * * * *